United States Patent [19]

Billi

[11] Patent Number: 4,731,974

[45] Date of Patent: Mar. 22, 1988

[54] MACHINES FOR PRODUCING INFUSION FILTER BAGS AND THEIR INDIVIDUAL PACKAGING IN AN OUTER ENVELOPE

[75] Inventor: Giorgio Billi, Bologna, Italy

[73] Assignee: I.M.A. - Industria Macchine Automatiche - S.p.A., Ozzano Emilia, Italy

[21] Appl. No.: 878,126

[22] Filed: Jun. 25, 1986

[30] Foreign Application Priority Data

Jun. 28, 1985 [IT] Italy ..... 3477 A/85

[51] Int. Cl.[4] ..... B65B 61/14

[52] U.S. Cl. ..... 53/134; 53/170; 53/558

[58] Field of Search ..... 53/134, 450, 170, 453, 53/205, 455, 206, 550, 228, 559, 234, 562, 449, 568, 229, 558; 493/210, 247, 212, 345, 223, 349, 224, 357, 243, 375

[56] References Cited

U.S. PATENT DOCUMENTS

| | | | |
|---|---|---|---|
| Re. 26,075 | 9/1966 | Canno | 493/210 X |
| 3,533,210 | 10/1970 | Peppler | 53/562 X |
| 3,566,573 | 3/1971 | Irmscher | 493/212 X |
| 3,805,483 | 4/1974 | Romagnoli | 53/134 |
| 4,201,031 | 5/1980 | Wiles | 53/562 X |
| 4,205,504 | 6/1980 | Gregoire et al. | 53/206 X |
| 4,288,224 | 9/1981 | Romagnoli | 493/345 |

FOREIGN PATENT DOCUMENTS

| | | | |
|---|---|---|---|
| 2058705 | 4/1981 | United Kingdom | 53/229 |

*Primary Examiner*—Robert L. Spruill
*Assistant Examiner*—Steven P. Weihrouch
*Attorney, Agent, or Firm*—Karl F. Ross; Herbert Dubno

[57] ABSTRACT

A machine for making infusion bags and packaging them in respective envelopes, e.g. tea bag packages, and formed with the usual rotary head having radial arms for displacing the infusion bags after they are filled, is provided with a device for drawing the envelope strip from a roll thereof, folding it into a V as flanks of unequal length, cutting individual V-shaped sections from the folded strip to form wedges, and a pincer arrangement in which an inner pincer has a pair of fingers which grip each infusion bag, withdraw it from the respective radial arm and hold it until another pincer arrangement swings a respective wedge into a position in which its flanks straddle the bag and are engaged by an outer pair of fingers of the pincer assembly. The assembly of the bag and wedge are returned to the pincers of the arm.

6 Claims, 12 Drawing Figures

MACHINES FOR PRODUCING INFUSION FILTER BAGS AND THEIR INDIVIDUAL PACKAGING IN AN OUTER ENVELOPE

SPECIFICATION

1. Field of the Invention

The present invention relates to an improvement of machines for producing infusion filter bags and their individual packaging in an other envelope.

More particularly, the invention relates to so-called automatic machines for producing such bags in succession from a strip or web of filter paper, introducing into these bags a set quantity or dose of infusion product, applying to the bags during its closing operation a string with a bag for handling the bag during use in order to obtain the infusion drink, and individually packaging the filter-bags thus obtained in a corresponding outer envelope.

2. Background of the Invention

A machine of this type is for example described and illustrated in U.S. Pat. No. 3,805,483 of the assignee I.M.A.-Industria Macchine Automatiche-S.p.A.

Such a machine can include a conveying wheel or head of the rotary type having several arms facing radially outward and equidistant along the wheel or head circumference. Several pincer type devices are each mounted on the arms for picking up and releasing a piece of filter paper. Devices for rotating intermittently said conveying head are provided in order to advance the pincer type process sequentially and intermittently along a predetermined path. Devices are provided for along this path and operate in cooperation with said pincer type devices in order to form filter paper bags from said pieces of filter paper. Means is provided for filling the completed bags when said pincer type devices are in a given position along the path in order to fill the filter paper bags picked up by the said pincer type devices with the infusion product. Other devices are provided to pincer type devices are moved to another predetermined position along said apply a string with label to each filled bags. Finally the apparatus has means for removing the filled bags from the pincer type devices and applying to them a protective cover and subsequently returning them thus covered to the pincer type devices.

Of the last mentioned devices, the devices for removing and returning the filled bags from and to the pincer type devices on the intermittently rotary head are substantially made up of pincer type devices reciprocating radially with regard to said intermittently rotating head. The devices for applying the protective cover (outer envelope) to the bags include substantially a reciprocating oscillating element for feeding the protective cover by suction and drawing devices having alternatively fixed and moving elements.

The actuation and coordination of movements of these moving elements requires a rather complex mechanism that limits the output rate of the machine, that is production per unit of time.

OBJECT OF THE INVENTION

It is an object of the invention to provide an improved machine of this type which will obviate this limiting factor.

SUMMARY OF THE INVENTION

Therefore, the improvement according to the present invention of a machine for the production of infusion filter bags and their individual packaging in an outer envelope comprises a conveying wheel or head of the rotating type and having several arms projecting radially outward from it and equidistant on its circumference. Several pincer type devices are each fitted to a respective one of the arms for picking up and releasing a single piece of filter paper.

A device is provided for rotating the head intermittently to sequentially and intermittently advance the pincer type devices along a given path. The machine also has devices for forming the bags displaced along the path and cooperating with the pincer the devices in order to form filter paper bags with said filter paper pieces. Means is provided for filling the completed bags when said pincer type devices are moved to a predetermined position along the path in order to fill the filter paper bags picked up by said pincer type devices with the infusion product. When the said pincer type devices are moved to another predetermined position along the path other devices apply a string with label to each filled bag picked up by the pincer type devices.

The machine also has means for removing the filled bags from said pincer type devices and applying to them a protective cover and subsequently returning the bags thus covered to the pincer type According to the invention, in a direction which is downstream machine wise according to the feeding direction of a strip or web of paper for the outer envelope, the machine comprises fixed drawing devices with opposed vertical elements so as to asymmetrically and longitudinally fold the strip or web of paper for the outer cover or envelope in the shape of a V with flanks of different length and counter-rotating preincisive roller devices suitable to impress a prefolding line along the longer flank of the V next to the end longitudinal edge of the shorter V flank. Further downstream are braking devices suitable for acting on the outer faces of the flanks and pulling devices for advancing intermittently, or step by step, the web of paper for the outer envelope, V folded between the fixed drawing devices, the preincisive roller devices and the braking devices. Cutting devices are provided to cut blanks from the V shaped web having a sufficient length as to contain between the V flanks the closed and filled filter paper bags.

In addition the envelope-making and bag-insertion mechanism includes first pincer type devices oscillating in the plane of the pincer type devices associated to the radial arms of said intermittently rotary wheel or head, second double pincer type devices, reciprocating radially with regard to the pincer type devices associated to the radial arms of the wheel that rotates intermittently when at rest; and devices for actuating synchronously the oscillating, opening and closing of the pincer elements of said first pincer type devices and respectively the to-and-fro, opening and closing action of the pincer elements of said second double pincer devices so as to cause a first pincer of said second double pincer devices to extract a completed filter paper bag from the corresponding pincer type devices on the rotary radial arm wheel, to displace the first pincer type devices from the position of pick up a V wedge to their oscillated position where said picked up bag finds itself between the V prongs of said wedge, to close the other pincer of said second double pincer devices for picking up externally said V wedge between whose flanks is found the bag picked up by said first pincer, and subsequently reinsert the inner bag-outer envelope wedge between the aforesaid pincer type devices of the aforesaid rotary radial arm wheel.

BRIEF DESCRIPTION OF THE DRAWING

Further characteristics and advantages of the machine according to the present invention shall become more evident from the detailed description that follows, with reference to the appended drawing in which.

SPECIFIC DESCRIPTION

Figure 1:
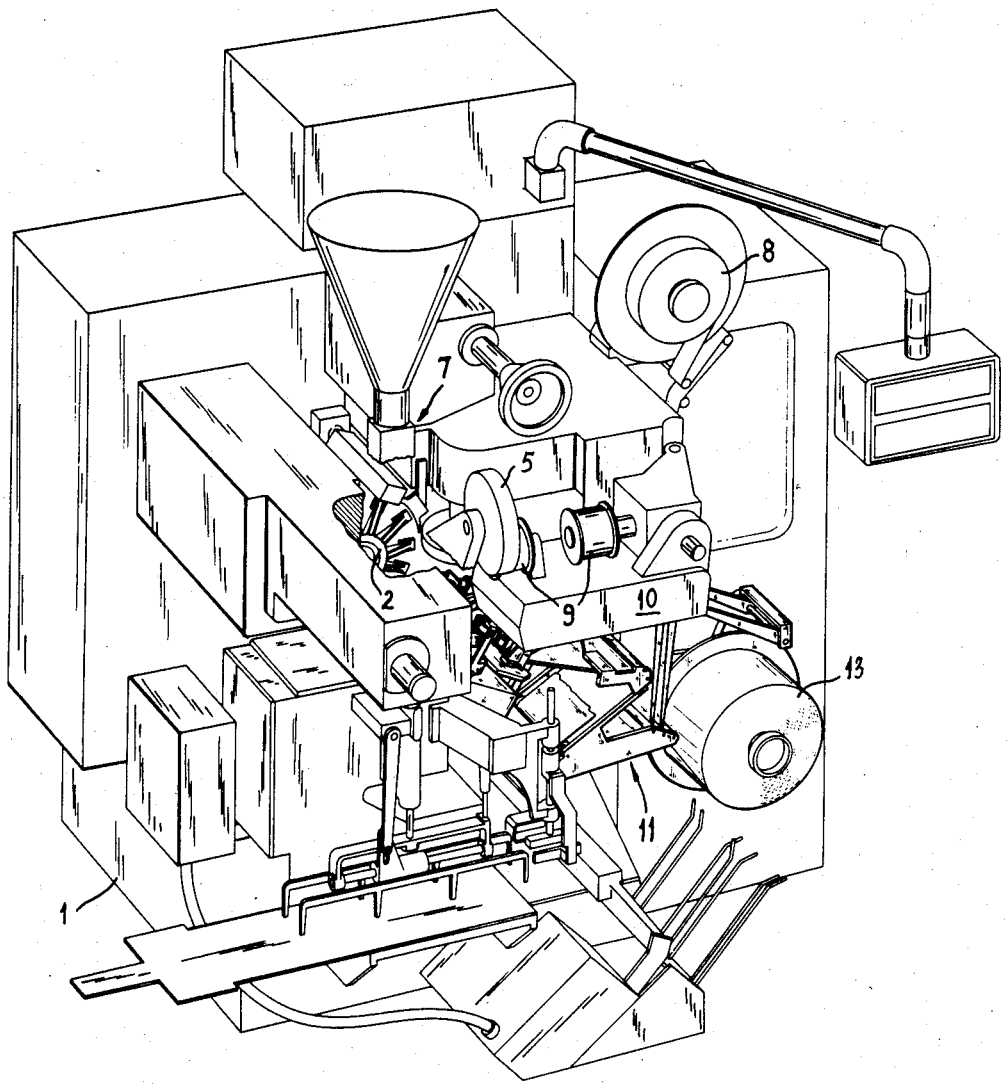
FIG. 1 shows schematically such a machine in a frontal perspective view.

The machine comprises a base 1 with a structure having a part extending vertically upwards. All moving parts are substantially located in the front of said vertically extending part. Of these moving parts in FIG. 1 one can see a wheel or head 2 with equidistant radial arms 3 (see FIG. 2) at the free end of each of which are provided pincer type devices 4 in accordance with the above U.S. Pat. No. 3,805,483. A reel 5 of filter paper for the formation of filter bags 6 (see FIG. 3D) containing the infusion product such as tea, camomile and the like is provided on the machine 1. A hopper 7 feeds the infusion product with a dosing device for the product to be fed to the filter bags 6 during their filling. A reel 8 supplies a web for labels of teas to be applied to a string (not shown) to be connected to the filter bag 6 for the handling of the latter during use in the preparation of the infusion drink. Two spools supply of metal wire for connecting the string with a tag to the filter bag 6 by means of metal staples with the help of device 10. The region 11 accommodates the parts affected by the improvement according to the present invention better described hereinafter with reference to FIGS. 2, 3, 4.

Figure 2:
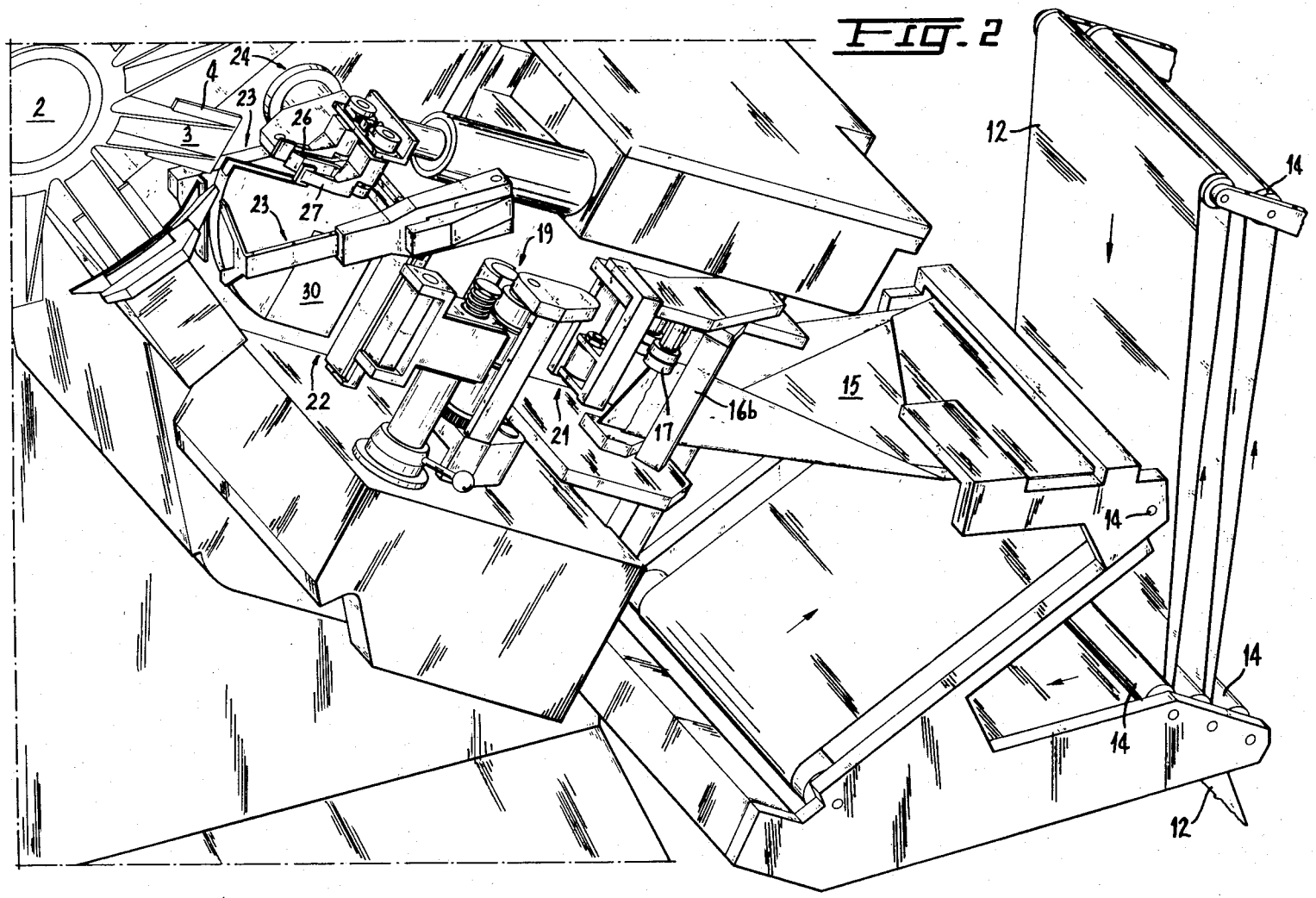
FIG. 2 shows, also in perspective and on enlarged scale, the part of the machine affected by the improvement according to the invention.

FIG. 2 shows a web 12 of material for the information of the outer envelopes for filter bags 6 in compliance with the improvement of the invention. The web is unwound from a corresponding reel 13 of such material (see also FIG. 1). Said web 12 during unwinding from the reel 13, as is customary, goes through idle diverting rollers 14 and is conveyed by the last of said rollers 14, with the help of plate 14, through fixed drawing devices 16 so as to fold it asymmetrically lengthwise in a V shape with prongs of different lengths (see in particular FIG. 3A). In the example given in FIG. 3A said fixed drawing device 16 is composed of two vertical elements **16*a* and 16*b*** with polygonal section so as to present a corresponding edge respectively counterfaced in contact with the outer surface of the web during its folding as a V with flanks having different lengths.

Downstream of the drawing devices 16 are two rollers 17 having preincisive devices counterrotating about substantially vertical axes **17*a* suitable impress a prefolding line 18 along the longer prong of the V made by the web 12 longitudinally folded, a prefolding line 18. Downstream of said preincisive rollers 17, so as to find themselves between these and a pulling device shown as a whole at 19 and better described hereafter, suitable to enable an intermittent progression or step by step advance of the strip or web 12 of paper for the formation of outer envelopes 20 for the filter bags 6, are located braking devices 21 that act on the external faces of the flanks of the V shape taken by said web 12. Said braking devices are essentially made up of a fixed abutment 21*a* and a free release roller 21*b* that turns freely about a substantially vertical axis under the action of a fixed support element 21*c* in juxtaposition to the fixed abutment 21*a*. Said pulling device 19 instead is made up essentially of two cylindrical rollers 19*a* and 19*b* with essentially vertical and counterrotating axes with the help of a corresponding supporting crown wheel or gear, 19*c*–19*d*, engaging both of them in the middle. Cylindrical roller 19*a* is equipped in the known manner with a peripheral area externally having a lesser radius than the remaining cylindrical part so as to determine the dwell time of the intermittent movement with which said cylindrical rollers 19*a* and 19*b* pull web 12** folded as a V as previously seen.

Downstream of said pulling device 19 is provided a cutting device 22 suitable for cutting wedges of the V folded web 12 having sufficient length to contain between the prongs of the V the filter bags 6, closed and filled with the infusion product along their length (see FIG. 2E). The cutting device 22 comprises essentially two cutting blades **22*a* and 22*b***, with reciprocating movement as shown by the positions indicated in the three FIGS. 3A, 3B and 3C.

Immediately upstream of cutting blades **22*a* and 22*b* of cutting device 22 is found a blade 28 oscillating about an axis 29 between the V prongs of folded web 12 so as to effect the detachment of the crosswise edges immediately after the cutting of wedges 25 by the blades 22*a* and 22*b* of cutting device 22. Immediately downstream of the cutting device 22 with blades 22*a* and 22*b* having reciprocating movement is provided a pincer 23 with two arms oscillating about an horizontal axis 24 substantially on the plane of the pincer devices 4 associated to radial arms 3 of the intermittently rotating wheel or head 2 of the machine. The end of the tines of said pincer 3 is formed like a hoe so as to present itself in a counterpose and is shaped essentially like a V. Such a pincer 23 (see FIG. 3) has been designed in order to pick in two points apart a wedge 25 near its V bottom just cut from web 12 by the cutting device 22**.

Immediately downstream of said cutting device 22 is provided a plough shaped element 30 with an arc of substantially 90°, having a double wall tending to maintain open as a V the sides of wedges 25 in order to insert between them the filter bag 6 as will be discussed below. double pincer devices 26 that radially reciprocate with the pincer devices 4 associated to radial arms 3 of the intermittently turning wheel of the machine. One of the double pincers is shown at 26 and is found between the prongs of the other pincer 27 (see FIGS. 3D, 3E, 3F and 4).

The synchronized oscillation movements about axis 24 and opening and closing of the prongs of pincers 23 and to-and-fro and opening and closing of pincers 26 and 27 in pratice have proved much more simple than those according to the above-mentioned patent of the applicant, which has enable a higher output in a unit of time.

Figures 3A, 3B, 3C, 3D, 3E, 3F, 3G, 3H, 3I:
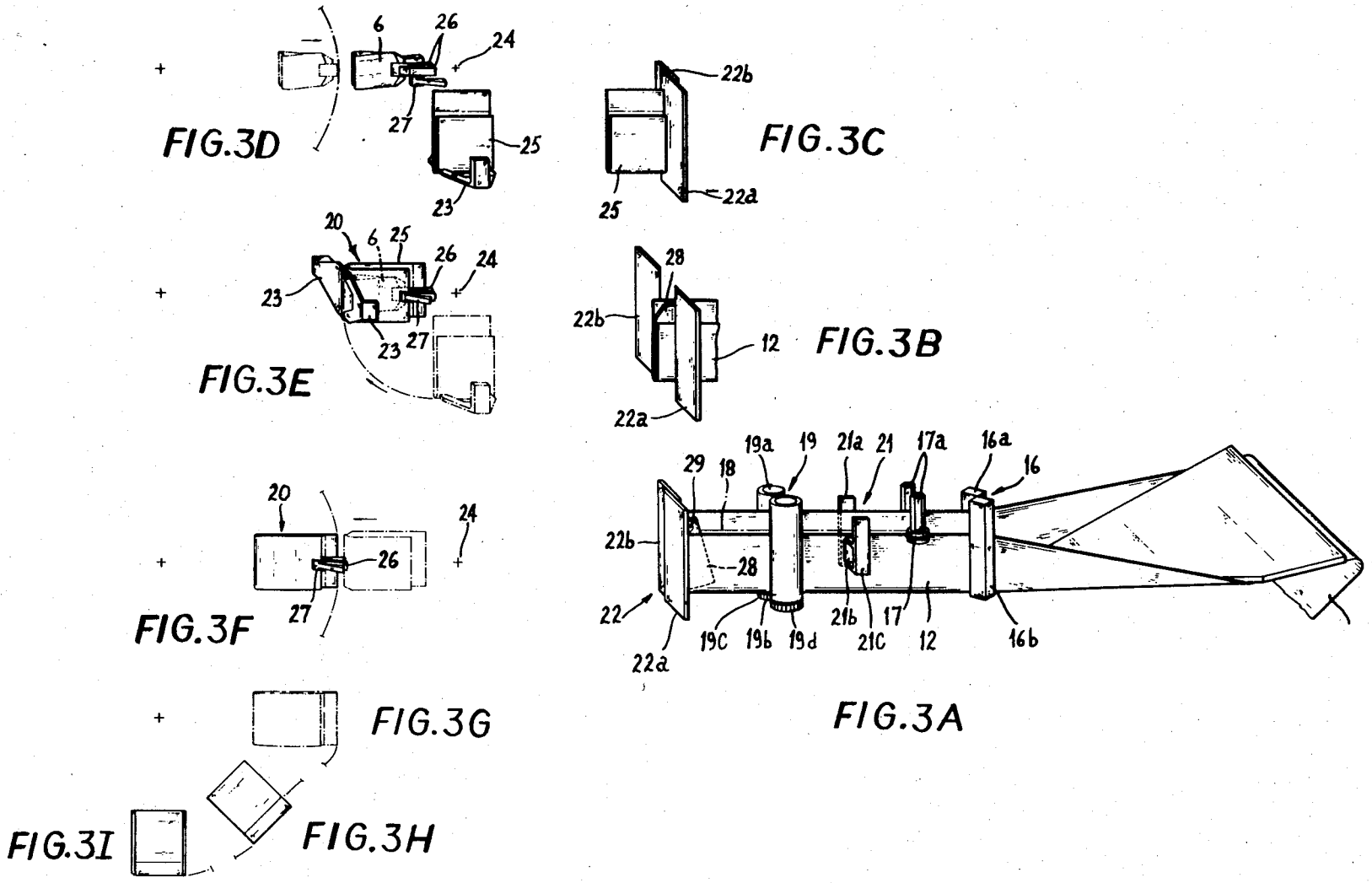
FIGS. 3A–3I are diagrams which the operating sequence of the part of the improved machine according to the present invention where the letters FIGS. 3A through 3I denote the relative operating positions of certain elements affected by the improvement.
Figure 4:
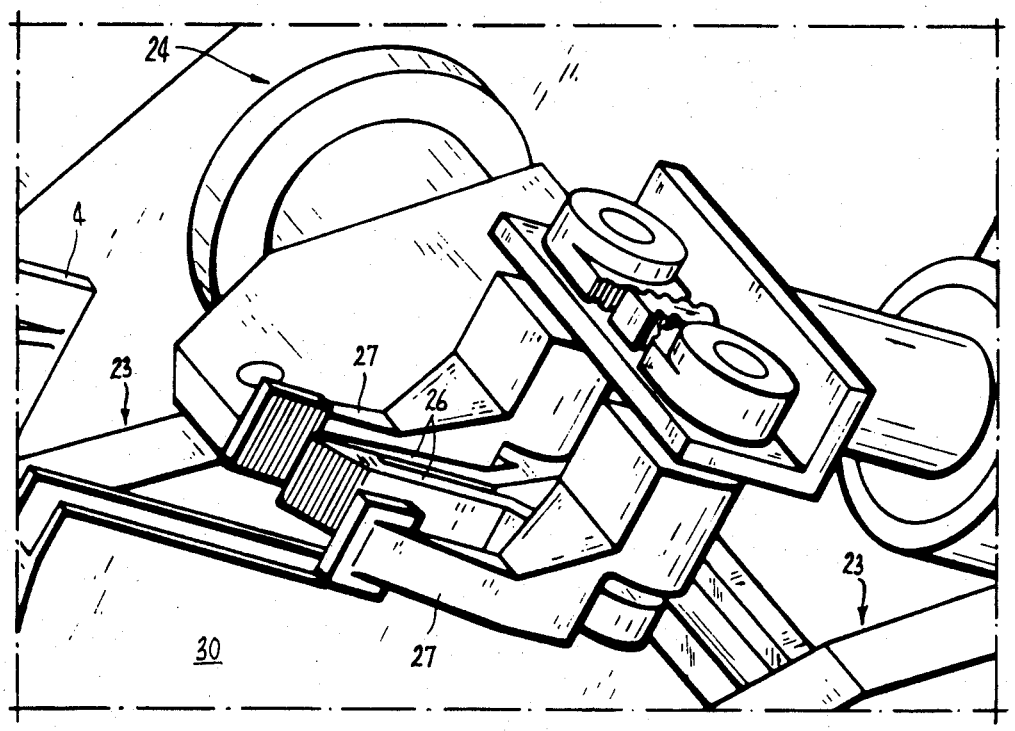
FIG. 4 shows, enlarged and in perspective view, the double pincer devices.

Such synchronism of movements as above indicated has been designed in order to make pincers 26 extract in succession the individual, complete filter paper bags 6 from the corresponding pincer devices 4 of wheel 2 in the external position to said wheel 2 as shown in FIG. 3D. The oscillating pincers 23 are swung from the position for picking up a V wedge 25 shown in the same FIG. 3D to its oscillated position shown in FIG. 3E where the filter bag extracted earlier is placed between the V prongs of said wedge 25. The pincers 27 are then closed (see FIG. 3E) for picking up from the outside the V wedge 25 between whose prongs is found the filter bag 5 picked up by said pincers 26, and subsequently to reintroduce the assembly of the inner filter bag 6/outer envelope wedge 20 between the aforementioned pincer devices 4 of wheel 2 (see FIG. 3F). The sealing of the outer envelope with the folding of the end marked by the prefolding line 18 on the longer prong of the V takes place in a known manner following the stages shown in FIGS. 3G, 3H and 3I.

What is claimed is:

1. In a machine for the production of filter bags for an infusion beverage, wherein a piece of filter paper is folded and filled with an infusion substance, closed to form a filter bag and the filter bag is provided with a string and a tag utilizing a rotary head provided with arms having respective pincers which carry said bag along a path, the improvement which comprises:

a supply of a strip of paper adapted to form envelopes for said bags, said strip being fed in a direction toward said head;

a fixed drawing device downstream of said supply and provided with a pair of juxtaposed vertical elements folding said strip into a V section with flanks of different lengths;

a pair of counter-rotating rollers between which said strip of V-section passes downstream of said elements and provided with means for impressing a longer one of said flanks adjacent to a longitudinal end of the shorter flank as a prefolding line;

braking means acting upon outer faces of said flanks for resisting displacement of said strip and located downstream of said counter-rotating rollers;

pulling means engaging said strip downstream of said braking means in said direction for intermittently advancing said strip between said elements, said rollers and said braking means;

cutting means downstream of said pulling means in said direction for severing from said strip successive wedges of paper folded in a V section and of a length sufficient to receive a respective one of said bags;

first pincer means swingable in a plane of said arms in one position of said arms on rotation of said head and receiving each wedge; and second pincer means juxtaposed with the pincer of each arm at said position and including an inner pincer formed with fingers adapted to engage a filter bag on one of said arms in said position, and an outer pincer having fingers juxtaposed with the fingers of said inner pincer, said second pincer means being reciprocatable toward and away from said arm at said position whereby:

upon advance of said second pincer means toward an arm at said position, said fingers of said inner pincer engage a bag carried by said arm at said position;

upon movement of said inner pincer means away from said arm at said position, said first pincer means swings a respective wedge between said second pincer means and said arm at said position to receive a filter bag gripped between the fingers of said inner pincer, said fingers of said outer pincer engage the respective flanks of the wedge receiving the filter bag in said inner pincer against the fingers of said pincer, and upon swinging of said first pincer means from between said second pincer means and said arm at said position, said second pincer means advances toward said arm at said position to insert the wedge and the filter bag received therein in the pincer of the arm at said position.

2. The improvement defined in claim 1 wherein said first pincer means is provided with a plow-shaped element having a double wall and a downstream arc of 90°.

3. The improvement defined in claim 1 wherein said vertical elements are of polygon cross section having edges in juxtaposition and engageable with outer faces of the flanks of the V into which said strip is folded.

4. The improvement defined in claim 1 wherein said pulling means comprises two cylindrical rollers receiving said strip between them and having substantially vertical axes with respective gears meshing with one another and driving the rollers of the pulling means in counter rotation, one of said rollers having a peripheral region with an external radius less than that of the remainder of the latter roller to establish a dwell stage during pulling of the strip by said cylindrical rollers.

5. The improvement defined in claim 1 wherein said first pincer means includes a pincer structure with a pickup end part in the shape of a V-shaped hoe.

6. The improvement defined in claim 1, further comprising upstream of said cutting means with respect to said direction, a blade oscillating between the flanks of the V-folded strip to detach edges of each wedge from the balance of the strip upon the cutting of the wedge from the strip.

* * * * *